US009630803B2

(12) United States Patent
Boss et al.

(10) Patent No.: US 9,630,803 B2
(45) Date of Patent: Apr. 25, 2017

(54) CART TYPE STRAP DISPENSER WITH IMPROVED STRAP BRAKE/PAYOUT ASSEMBLY

(75) Inventors: Walter L. Boss, Lindenhurst, IL (US); Daniel R. Pearson, Ingleside, IL (US); Wayne J. Skonieczny, Jr., Cary, IL (US); Michael T. Schmitt, Hawthorn Woods, IL (US); Lawrence J. Schurder, Barrington, IL (US); Thomas J. Kelley, Lindenhurst, IL (US)

(73) Assignee: SIGNODE INDUSTRIAL GROUP LLC, Glenview, IL (US)

( * ) Notice: Subject to any disclaimer, the term of this patent is extended or adjusted under 35 U.S.C. 154(b) by 980 days.

(21) Appl. No.: 12/718,601

(22) Filed: Mar. 5, 2010

(65) Prior Publication Data

US 2011/0108655 A1 May 12, 2011

Related U.S. Application Data

(60) Provisional application No. 61/260,620, filed on Nov. 12, 2009.

(51) Int. Cl.

| | |
|---|---|
| ***B65H 75/28*** | (2006.01) |
| ***B65H 49/32*** | (2006.01) |
| ***B65H 75/24*** | (2006.01) |

(52) U.S. Cl.

CPC ..... *B65H 75/285* (2013.01); *B65H 49/32* (2013.01); *B65H 75/242* (2013.01); *B65H 2701/375* (2013.01)

(58) Field of Classification Search

CPC ..... B65B 13/185; B21C 47/34; B65H 49/321; B65H 2701/375; B65H 75/24; B65H 75/285; B65H 49/32; B65H 75/242

USPC ..... 242/422.4, 403, 403.1, 557, 533.8, 401, 242/577, 577.2, 577.3, 577.4

See application file for complete search history.

(56) References Cited

U.S. PATENT DOCUMENTS

| | | | | | |
|---|---|---|---|---|---|
| 108,680 | A | * | 10/1870 | Briggs | 242/577 |
| 803,374 | A | * | 10/1905 | Volkerding et al. | 242/401 |
| 1,542,485 | A | * | 6/1925 | Stevenson | 242/577.4 |
| 1,728,106 | A | * | 9/1929 | Collins | 242/577 |
| 2,506,354 | A | * | 5/1950 | Green | 242/422.4 |
| 2,821,726 | A | * | 2/1958 | Correll | 242/403 |
| 3,826,443 | A | * | 7/1974 | Goodley | 242/615 |
| 3,840,713 | A | * | 10/1974 | Carpentier | 242/406 |
| 4,192,473 | A | * | 3/1980 | Wellman | 242/391 |
| 4,381,087 | A | * | 4/1983 | Williams | 242/597.1 |
| 5,400,982 | A | * | 3/1995 | Collins | 242/560 |

(Continued)

*Primary Examiner* — William A Rivera

(74) *Attorney, Agent, or Firm* — Levenfeld Pearlstein, LLC

(57) ABSTRACT

A dispenser is used for dispensing flexible material from a coil. The dispenser includes a frame, a coil carriage mounted to the frame and a brake/payout assembly mounted to the frame. The frame defines an axis of rotation about which the coil carriage rotates. The coil is securable within the coil carriage for rotation with the carriage. The brake/payout assembly is operably mounted to the frame and is moveable toward and away from the coil carriage. The brake/payout assembly is biased toward the coil carriage for engagement with the carriage. The brake/payout assembly engages the coil carriage to slow rotation of the carriage and includes a nip region through which the flexible material traverses during payout.

12 Claims, 3 Drawing Sheets

(56) References Cited

U.S. PATENT DOCUMENTS

| | | | | |
|---|---|---|---|---|
| 5,988,559 | A * | 11/1999 | Gnass | B65H 54/585 242/395 |
| 6,659,389 | B1 * | 12/2003 | Hoffmann et al. | 242/532.6 |
| 6,908,060 | B2 * | 6/2005 | Hibbs | 242/578.2 |
| 6,932,294 | B1 * | 8/2005 | Larson | 242/390.5 |
| 7,331,543 | B2 * | 2/2008 | Yu Chen | 242/597.4 |
| 2003/0085316 | A1 * | 5/2003 | Mostowy | 242/557 |

* cited by examiner

CART TYPE STRAP DISPENSER WITH IMPROVED STRAP BRAKE/PAYOUT ASSEMBLY

CROSS-REFERENCE TO RELATED APPLICATION DATA

This application claims the benefit of priority of Provisional U.S. patent application Ser. No. 61/260,620, filed Nov. 12, 2009, the disclosure of which is incorporated herein by reference.

BACKGROUND OF THE INVENTION

The present invention pertains to a strap dispenser. More particularly, the present invention pertains to a dispenser for flexible material, such as plastic or metal strap, with an improved brake/payout assembly and an improved retention guard for easy coil loading.

Coil dispensers are used as a source or supply of coil material for many operations. Such coils are often supported on carts for ease of transportation and handling.

Issues have arisen with cart type dispensers in so far as braking and off-center pulling of strap from the coil, also referred to as strap pull down. Issues also arise with loading coils onto dispensers due the weight of the coils, and with inconsistent and not well controlled strap payout.

It has also been found that coils that are out of round, typically as a result of crushed cores, can also be problematic in that they may not properly sit in the dispenser and as such may not properly pay out strap.

Accordingly, there exists a need for a cart type coil dispenser that has an improved strap brake/payout assembly. Preferably, such a dispenser has an improved retention guard and easy coil loading. More preferably still, such a dispenser controls strap payout, and minimizes or prevents coil pull down.

BRIEF SUMMARY OF THE INVENTION

A dispenser is configured for dispensing flexible material such as plastic or metal strap from a coil having a core or a core-less coil. The coil may be wound onto a peripheral wall of the core.

The dispenser includes a frame that defines and axis of rotation and a coil carriage mounted to the frame for rotation about the axis of rotation. The coil is securable within the coil carriage for rotation on the frame with the carriage.

The dispenser includes a brake/payout assembly operably mounted to the frame and moveable toward and away from the coil carriage. In a present embodiment, the brake/payout assembly is pivotally mounted to the frame and is biased toward the coil carriage for engagement therewith.

The brake/payout assembly engages the coil carriage to slow rotation of the carriage. The brake/payout assembly includes a nip region through which the strap traverses during payout to control payout of the strap.

In a current embodiment the coil carriage includes a front guard, a rear guard and coil retaining elements to secure the coil between the guards. In one embodiment, the carriage includes three coil retaining elements and one of the coil retaining elements is adjustably mounted to the carriage.

The brake/payout assembly is configured to engage one or both of the front and rear guards. In a present embodiment, the brake/payout assembly includes a contact roller that is configured to contact the front and/or rear guard to slow rotation of the coil carriage.

The brake/payout assembly can include a feed roller biasedly mounted toward the contact roller. The rollers define the nip region therebetween. The strap is configured for receipt in the nip region as it is paid out from the coil.

The contact roller can include one or more contact pads on a periphery thereof for contact with the front and/or rear guards. The contact and feed rollers can be formed from a low friction material.

A present dispenser is formed as a cart with wheels for ease of movement, transport and positioning of coils.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
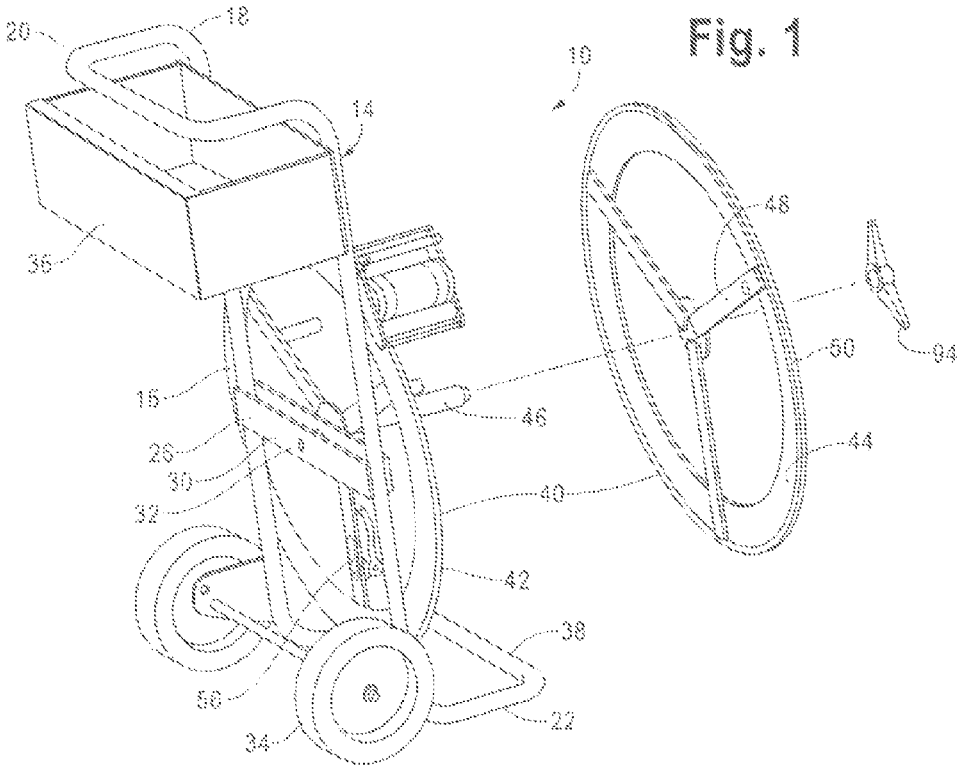
FIG. 1 is a rear perspective view, partially exploded, of a strap dispenser embodying the principles of the present invention.
Figure 2:
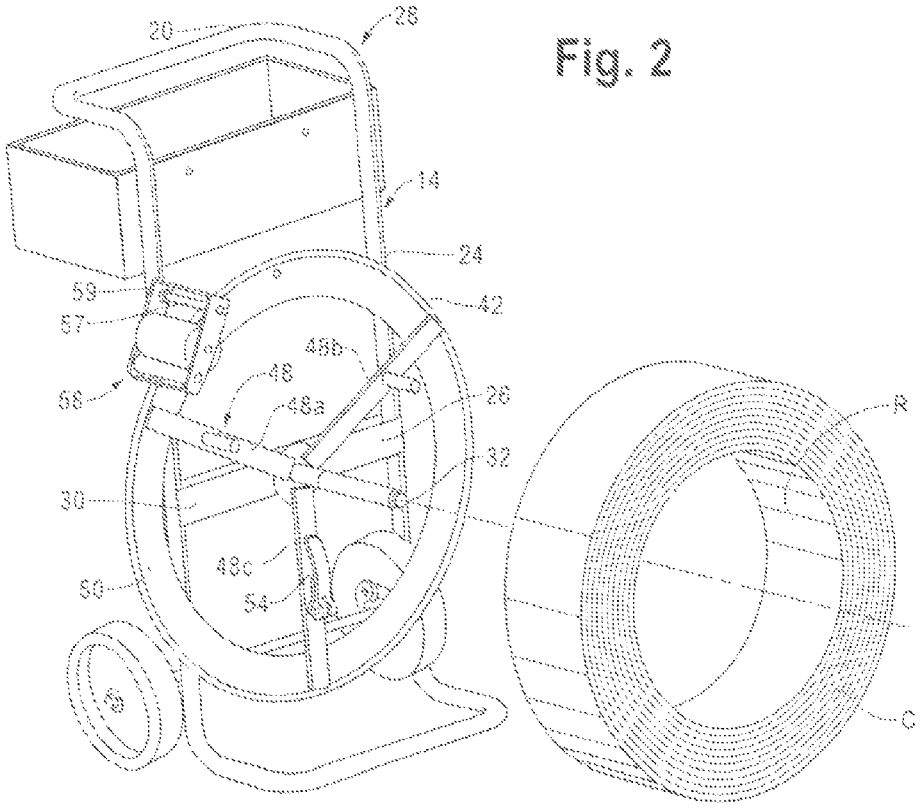
FIG. 2 is a front perspective view of the dispenser shown without the front guard and with a coil being positioned on the dispenser.
Figure 3:
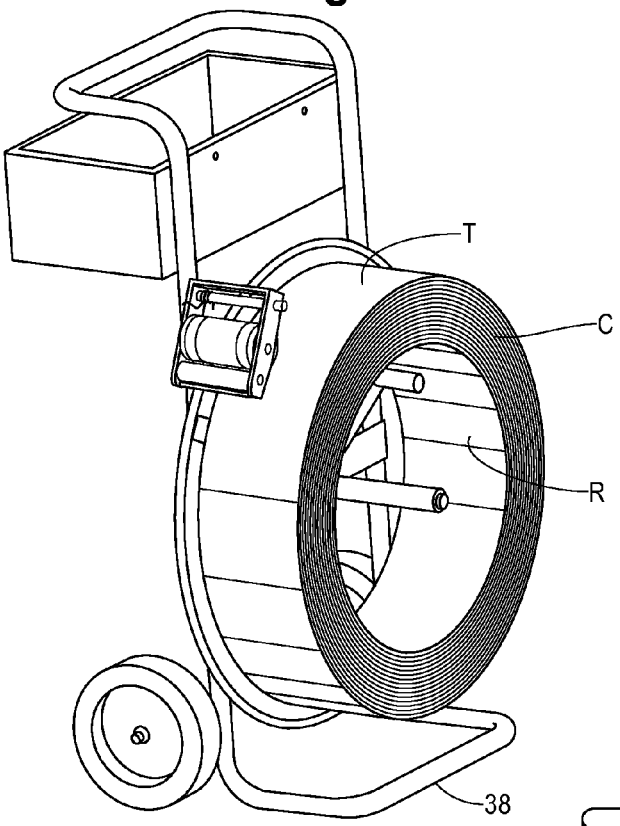
FIG. 3 is a front perspective view of the dispenser, again shown without the front guard, but with the coil positioned on the dispenser.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures there is shown a cart type strap dispenser 10 with improved brake/payout assembly and easy coil loading embodying the principles of the present invention. The dispenser 10 is formed as a rolling cart and includes a frame 14, having a back 16, a top 18 including a handle 20, and a bottom or base 22. The frame 14 can be formed from tubular elements, as shown, to improve strength and endurance and to reduce overall costs. The bottom 22, back 16 and handle 20 are formed from vertical uprights 24 and one or more cross-pieces 26. The upper portion 28 of the cart 10 can be removable for shipping and storage. A pair of braces 30 extend between the uprights 24 of the back 16. An axle or stub 32 (the rear part of which is shown) extends outwardly or forwardly from the braces 30.

To facilitate moving the coil C and cart 10, the cart 10 is configured with wheels 34. A basket or bin 36 can be disposed at about the handle 20. The base 22, opposite of the wheels 34 can be formed as a tubular member, optionally with a rubber or other non-slip (high friction) surface 38.

A coil carriage 40 is mounted to the cart 10. In a present embodiment, the carriage 40 is mounted on the axle 32 that extends outward from the braces 30. The carriage 40 includes a rear guard 42, a front guard 44 and a spindle 46 on which the front 44 and rear 42 guards are positioned. As can be seen in the figures, the coil C is sandwiched between the guards 42, 44.

The spindle 46 is configured to ride on the axle 32—as such the spindle 46 can be hollow to allow the spindle 46 to slide onto the axle 32. The entire carriage 40 is thus configured to rotate about the axle 32, on the cart 10.

Each the rear 42 and the front 44 guards are formed by spoke members 48 and a ring member 50 at about the ends of the spoke members 48. The coil C is sandwiched between the guards 42, 44 when in position on the dispenser 10. As will be discussed below, this is important to prevent strap pull-down. In a present embodiment, there are three spoke members 48*a-c* positioned at 120 degrees from one another. It will, however be appreciated that other numbers of spoke members (e.g., four, five or the like) can be used to support the ring member 50, and that carriages 40 with such other numbers of spoke members 48 are within the scope and spirit of the present invention.

Coil posts 52 are positioned on two of the rear guard spoke members, 48*a,b*, extending outwardly, or toward the front guard 44. The posts 52 are configured for receiving the coil C—that is, the coil C (actually, the core R of the coil C) rests on the posts 52. A clamp member 54, such as the illustrated cammed clamp, is configured to move up to and against the core R, to lock the core R (and thus the coil C) between the posts 52 and the clamp 54 on the carriage 40. The clamp 54 is fitted into a slotted opening 56 in the spoke 48*c* to allow the clamp 54 to move inward and outward so that it can be snugged up against the core R.

The present arrangement, which uses two posts 52 and a clamp 54 at 120 degrees from one another is configured to allow for the use of a coil C (core R) that may be out of round, for example, a crushed core, in the dispenser 10. Conventional dispensers do not function well with such out-of-round coils, and as such some other means to use the strap must be devised. The present configuration, on the other hand, allows for using such out-of-round coils, and prevents the coil C from moving or shifting between the posts 52 and clamp 54, and maintains the coil C centered, as the carriage 40 rotates in the dispenser 10.

The dispenser 10 includes a brake/payout guide assembly 58. The assembly 58 is mounted to the frame 14 along, for example, one of the back vertical posts 24. The assembly 58 is pivotally, biasedly mounted to the dispenser 10 (by a post 57 and spring 59) to urge the assembly 58 into contact with the coil C and/or the coil carriage 40. In a present dispenser 10, the brake/payout assembly 58 contacts the carriage 40 at one or both of the front 44 and rear 42 guards to provide a braking function. It will, however, be appreciated that the assembly 58 can be configured to contact the coil C instead of or in addition to the guards 42, 44.

The assembly 58 includes a bracket 60 having a contact roller 62 and a feed roller 64. The feed roller 64 is biased (by one or more springs 66) toward the contact roller 62. In use, strap S is dispensed from the top T of the coil C (a top payout) and is threaded into a payout control portion or nip region 68 between the contact 62 and feed 64 rollers. This prevents uncontrolled payout of the strap S by absorbing any inertia generated by the "pulled" strap at the pinch region 68 between the rollers 62, 64.

Figure 6:
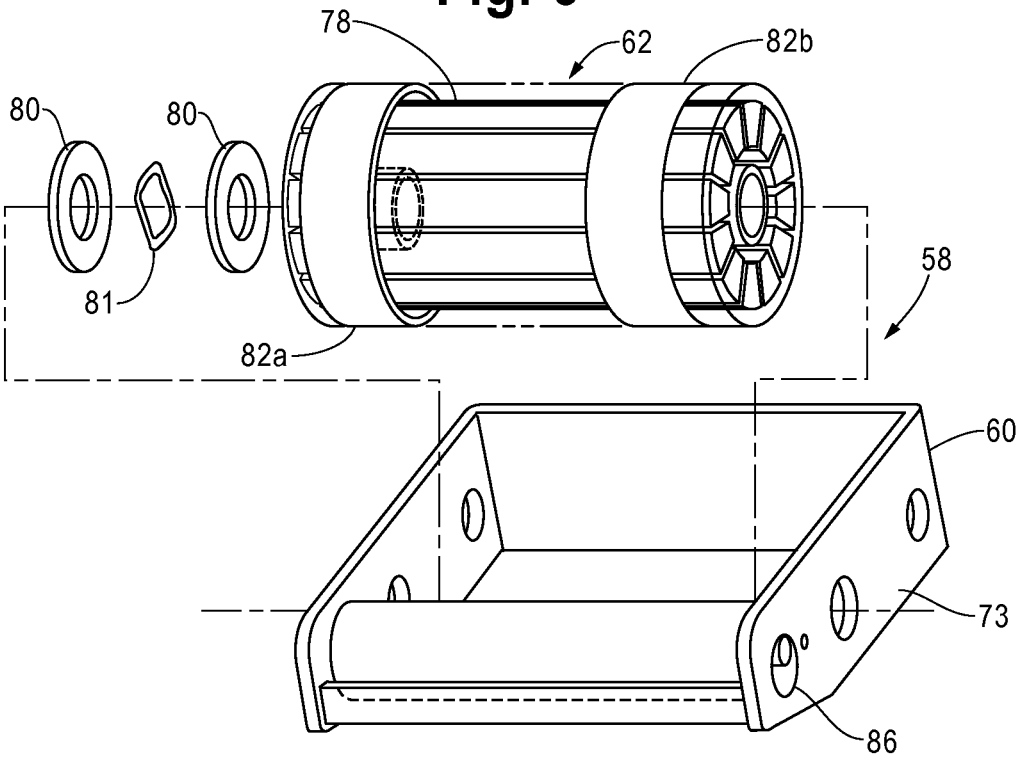
FIG. 6 is a partially exploded view of the brake/payout guide assembly of FIG. 5.

The contact roller 62 is mounted to the bracket 60 by an axle 70. A bearing set 72 (presently a needle bearing set) is disposed in the center opening 74 in the roller 62 to allow the contact roller 62 to freely roll about the axle 70. A one-way clutch 76 is positioned at about one end of the roller 62 (as it is mounted to the bracket 60), to allow for forward rotation of the roller 62 and to prevent rearward rotation. The one-way clutch 76 can take the form of a one-way bearing, as indicated at 78. The roller 62 can be mounted to the bracket 60 with washers 80 and a spring washer 82 (see FIG. 6) on the axle 70 to maintain the roller 62 centered and in tension in the bracket 60. This configuration also facilitates slowing the roller 62, and urges the roller against bracket wall 73 to prevent strap from inadvertently slipping between the roller 62 and the wall 73.

The contact roller 62 includes friction-surface contact pads 82. In a present configuration, there are two pads, 82*a,b*, one each positioned to contact the front 44 and rear 42 guards when the dispenser 10 is loaded with a narrowest (3 inch) coil C. When the dispenser 10 is loaded with a widest (e.g., 6 or 8 inch) coil C, the rear contact pad 82*a* contacts the rear guard 42, but the front contact pad 82*b* does not contact the front guard 44.

The feed roller 64 is maintained in contact with the contact roller 62. The feed roller 64 is mounted to the bracket 60 by an axle 84 that is positioned in an oversized opening 86—that is, the opening 86 is sufficiently larger than the axle 84 so that the feed roller 64 can move toward and away from the contact roller 62.

The one or more springs 66 are positioned to urge the feed roller 64 into contact with the contact roller 624. In a present embodiment, the springs 66 are positioned between a spring block 90 and the axle 84 to urge the feed roller 64 (by applying a force on the axle 84) toward (and into engagement with) the contact roller 62.

In a present embodiment, both the contact 62 and feed 64 rollers are formed from a low friction material such as a low friction plastic, to allow the strap S to be freely pulled from the coil C, but in a controlled manner. It will be appreciated that one or both of the rollers 62, 64 can be formed from other materials, such as various metals and the like and retain the desired low friction characteristics.

Figure 4:
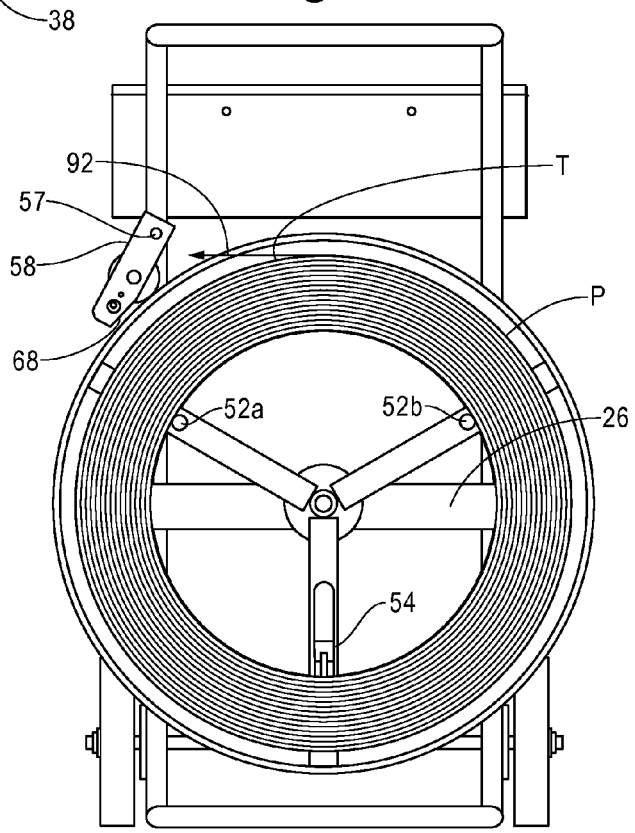
FIG. 4 is a front view of the strap dispenser.
Figure 5:
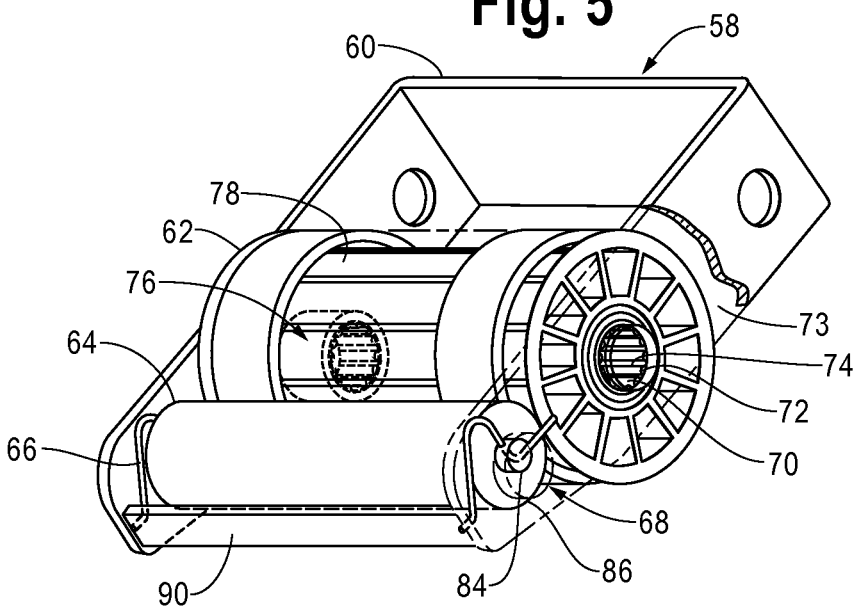
FIG. 5 is perspective view of the brake/payout guide assembly.

Use of the dispenser 10 is straight-forward. Strap S is fed from the top T of the coil C into the nip region 68 between the contact 62 and feed 64 rollers and is fed to the downstream equipment (e.g., a packaging or strapping machine, not shown). Strap S is fed from the below the rollers 62, 64, upward into the nip 68, and over the feed roller 64. As strap S is pulled from the coil C (see directional arrow at 92 in FIG. 4), it is pinched to prevent generating slack between the coil C and the brake/payout assembly 58. The spring 59 force exerted by the brake/payout assembly 58 on the guards 42, 44 (or the coil C) is sufficient to brake continued rotation of the coil C.

It will be understood that pull down, or pulling the strap S downward along the side of the coil C (rather than from the top T of the coil C), is a problem situation that must be prevented. Otherwise, the strap S can get caught on the spindle 46 and cause strap feed problems.

The present dispenser 10 prevents such undesirable pull down occurrences by the engagement of the guards 42, 44 with the sides of the coil C, at the core R. Specifically, the front and rear guard spoke members 48 maintain the coil strap along the periphery P of the coil (at the top T). As such, if the strap S slips from the periphery P, toward the spindle 46, the position of the spoke members 48 engaging the core R prevents the strap S from slipping down any further than the location at which the spoke members 48 contact or engage the core R. And, as the coil C continues to rotate, the strap S is pulled from between the coil C and the spoke members 48 and is realigned to the top T or periphery P of the coil C as the spoke member 48 approaches the twelve o'clock position. In this manner, strap pull down is prevented and the strap S is maintained at the coil periphery P.

Another feature of the present dispenser 10 is an optional quick-release center hub nut or hub lock 94. One such hub nut 94, which is illustrated in FIG. 1, can be configured so that it slides along the spindle 46 and begins to thread at the point at which the nut 94 is tightened onto the spindle 46, abutting the front guard 44. This reduces the time needed to loosen the nut 94, remove the front guard 44, replace a strap coil C and replace the guard 44 and nut 94. The nut 94 can be configured as a wing-type nut, a knurled knob or any other manually operable element. Such quick-release fasteners (e.g., quick release nuts), as well as other securing elements, traditionally threading or otherwise, will be recognized by those skilled in the art, and are within the scope and spirit of the present invention.

The present dispenser 10 has a number of advantages over those presently known. First, the dispenser 10 is loaded (with a coil C) in the upright or standing position. This eliminates the need to lay the dispenser 10 on its side to load a coil C and then stand the dispenser 10 upright for use. In that coils C can weigh in excess of 100 pounds this makes loading and use easier than known dispensers. In addition, as set forth above, the unique design of the front 44 and rear 42 guards (and the spoke members 48) prevents undesirable pull down, and provides an auto-fed realignment of strap S from the coil C during pay out from the dispenser 10. In addition, the quick release hub 94, easy-to-handle front guard 44 and coil support posts 52 and coil lock (clamp 54) facilitate ready coil C replacement. The carriage 40 design and brake/payout assembly 58 configuration make strap pay out consistent and paced.

In addition, it will be appreciated that the dispenser 10 has a low center of gravity which reduces the opportunity for tipping or general instability in use. It will also be appreciated that the dispenser 10 design allows for using the dispenser 10 with a wide variety of strap S sizes (widths) and types. As set forth above, the brake/payout guide assembly 58 is a single width and is usable with any width coil C that can be used on the dispenser 10. Thus, unlike known dispensers which require adjusting the width of the brake or guide assembly for each coil width, the present dispenser 10 is more quickly loaded and set up for use with a universal brake/payout guide assembly 58.

All patents referred to herein, if any, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A dispenser for dispensing flexible material from a coil having a core, comprising:

a frame having an axle;

a coil carriage mounted to the frame, the axle defining an axis of rotation about which the coil carriage rotates, the coil being securable within the coil carriage for rotation therewith, the coil carriage comprising a front guard and a rear guard and a plurality of spokes extending radially relative to the axle from a first radially inner position to a second radially outer position;

coil retaining elements mounted to the carriage to secure the coil between the front and rear guards, each coil retaining element mounted to a respective spoke of the plurality of spokes and projecting in an axial direction outward from a radial position between the first radially inner position and the second radially outer position on its respective spoke, the coil retaining elements including a plurality of fixed coil retaining elements each fixed relative its respective spoke, and an adjustable coil retaining element having a clamp fitted into a slotted opening in one of the spokes of the plurality of spokes and movable along its respective spoke between the first radially inner position and the second radially outer position to selectively engage the core, wherein in the second radially outer position the adjustable coil retaining element abuts against the core; and a brake/payout assembly operably mounted to the frame and moveable toward and away from the coil carriage, the brake/payout assembly being biased toward the coil carriage for engagement therewith, the brake/payout assembly including a contact roller and a feed roller movable toward and away from the contact roller, the feed roller being biasedly mounted toward the contact roller, the contact roller and the feed roller defining a nip region therebetween;

wherein the flexible material is configured for receipt in the nip region as it is paid out from the coil, and wherein the contact roller engages the coil carriage to slow rotation of the carriage.

2. The dispenser in accordance with claim 1 wherein the dispenser is formed as a cart.

3. The dispenser in accordance with claim 1 wherein the brake/payout assembly engages one or both of the front guard and the rear guard.

4. The dispenser in accordance with claim 1 wherein the brake/payout assembly is pivotally mounted to the frame.

5. The dispenser in accordance with claim 1 including at least three coil retaining elements.

6. The dispenser in accordance with claim 1 wherein the contact roller includes one or more contact pads on a periphery thereof for contact with the one or both of the front and rear guards.

7. The dispenser in accordance with claim 1 wherein one or both of the contact roller and the feed roller are formed from a low friction material.

8. A dispenser for dispensing flexible material from a coil, the coil having a core, the dispenser comprising:

a frame;

a coil carriage mounted to the frame, the frame defining an axis of rotation about which the coil carriage rotates, the coil carriage having first and second guard elements for securing the coil therebetween and a plurality of spokes extending radially relative to the axis of rotation from a first radially inner position to a second radially outer position, the coil carriage configured for rotation on the frame about the axis of rotation;

at least three coil retaining elements to secure the coil in the coil carriage, each coil retaining element mounted to a respective spoke of the plurality of spokes and positioned between the first radially inner position and second radially outer position, and at least one of the coil retaining elements being adjustable along a portion of one of the spokes of the plurality of spokes and movable in a radial direction relative to the axis of rotation between the first radially inner position and the second radially outer position, the at least one coil retaining element having a clamp fitted into a slotted opening on the spoke and adjustable so as to selectively engage a portion of the core, wherein in the second radially outer position the adjustable coil retaining element abuts against the core;

a brake/payout assembly operably mounted to the frame and moveable toward and away from the coil carriage, the brake/payout assembly including a contact roller and a feed roller movable toward and away from the contact roller, the feed roller being biasedly mounted toward the contact roller, the brake/payout assembly engageable with the coil carriage to slow rotation of the carriage, the brake/payout assembly including a payout portion through which the flexible material is captured during payout.

9. The dispenser in accordance with claim 8 wherein the brake/payout assembly is pivotally mounted to the frame and biased toward the coil carriage.

10. The dispenser in accordance with claim 8 wherein the brake/payout assembly includes a feed roller biasedly mounted toward a contact roller and defining the payout portion therebetween, and wherein the flexible material traverses through the payout portion as it is paid out from the coil.

11. The dispenser in accordance with claim 10 wherein the contact roller includes one or more contact pads on a periphery thereof for contact with the coil carriage.

12. The dispenser in accordance with claim 10 wherein one or both of the contact roller and the feed roller are formed from a low friction material.

* * * * *